US010551784B2

(12) United States Patent
Endo

(10) Patent No.: US 10,551,784 B2
(45) Date of Patent: Feb. 4, 2020

(54) IMAGE FORMING APPARATUS HAVING A PRESSING MEMBER THAT PRESSES SHEETS AGAINST A TRAY

(71) Applicants: KABUSHIKI KAISHA TOSHIBA, Tokyo (JP); TOSHIBA TEC KABUSHIKI KAISHA, Tokyo (JP)

(72) Inventor: Kenji Endo, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 192 days.

(21) Appl. No.: 15/710,281

(22) Filed: Sep. 20, 2017

(65) Prior Publication Data

US 2018/0224789 A1 Aug. 9, 2018

(30) Foreign Application Priority Data

Feb. 3, 2017 (JP) ..... 2017-018631
Jul. 24, 2017 (JP) ..... 2017-142676

(51) Int. Cl.
*G03G 15/00* (2006.01)
*G03G 21/20* (2006.01)
*G03G 15/20* (2006.01)

(52) U.S. Cl.
CPC ..... *G03G 15/6508* (2013.01); *G03G 15/6511* (2013.01); *G03G 15/2032* (2013.01); *G03G 15/2053* (2013.01); *G03G 21/20* (2013.01); *G03G 2215/00358* (2013.01); *G03G 2215/00396* (2013.01)

(58) Field of Classification Search
CPC ..... G03G 15/6508
USPC ..... 271/145
See application file for complete search history.

(56) References Cited

U.S. PATENT DOCUMENTS 7,549,633 B2 * 6/2009 Nishitani ..... B65H 1/26 271/145
2013/0002782 A1 * 1/2013 Kawaguchi ..... G03G 15/6585 347/179

FOREIGN PATENT DOCUMENTS

JP 2000062965 A 2/2000
JP 2016167035 A 9/2016

OTHER PUBLICATIONS

Yamakawa. Translation of JP 2000062965 A. Published Aug. 1998. Translated May 2019. (Year: 1998).*

* cited by examiner

*Primary Examiner* — Walter L Lindsay, Jr.
*Assistant Examiner* — Philipmarcus T Fadul
(74) *Attorney, Agent, or Firm* — Kim & Stewart LLP

(57) ABSTRACT

An image forming apparatus includes a tray configured to accommodate a plurality of sheets which are conveyed out of the tray for printing, a pressing member movable between a first position at which the pressing member presses the plurality of sheets against the tray and second position at which the pressing member does not press the plurality of sheets against the tray, a drive mechanism configured to cause the pressing member to be moved between the first and second positions, and a control unit configured to control the drive mechanism to move the pressing member into the first position, while a sheet is not supplied for printing from the tray and into the second position while the sheet is supplied for printing from the tray.

18 Claims, 8 Drawing Sheets

IMAGE FORMING APPARATUS HAVING A PRESSING MEMBER THAT PRESSES SHEETS AGAINST A TRAY

CROSS-REFERENCE TO RELATED APPLICATION

This application is based upon and claims the benefit of priority from Japanese Patent Application No. 2017-018631, filed Feb. 3, 2017, and Japanese Patent Application No. 2017-142676, filed Jul. 24, 2017, the entire contents of which are incorporated herein by reference.

FIELD

Embodiments described herein relate generally to an image forming apparatus.

BACKGROUND

A sheet that is used in an image forming apparatus is curled when left unattended for a long time in an environment where temperature and humidity are not controlled. Furthermore, a sheet which has been processed for reuse may be curled.

When the curled sheet is used, in some cases, a jam occurs.

DETAILED DESCRIPTION

Figure 1:
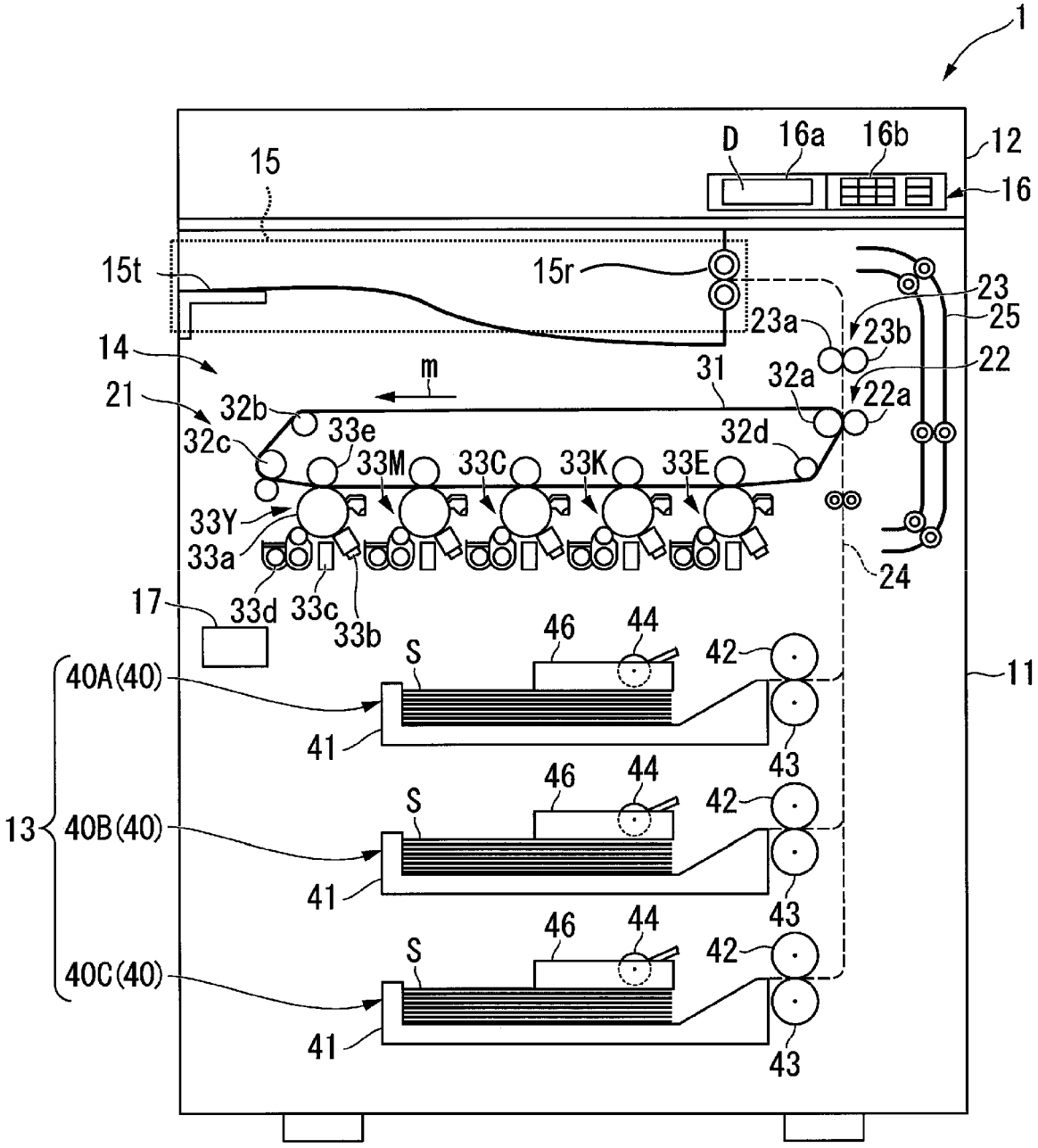
FIG. 1 is a vertical cross-sectional diagram of an image forming apparatus according to an embodiment.

Embodiments provide an image forming apparatus that is capable of reducing the occurrence of jams.

In general, according to one embodiment, there is provided an image forming apparatus including a tray configured to accommodate a plurality of sheets which are conveyed out of the tray for printing, a pressing member movable between a first position at which the pressing member presses the plurality of sheets against the tray and second position at which the pressing member does not press the plurality of sheets against the tray, a drive mechanism configured to cause the pressing member to be moved between the first and second positions, and a control unit configured to control the drive mechanism to move the pressing member into the first position, while a sheet is not supplied for printing from the tray and into the second position while the sheet is supplied for printing from the tray.

An image forming apparatus according to embodiments will be described below with reference to the drawings. It is noted that in the following description, constituent elements having the same or similar function are given the same reference numeral. Then, in some cases, overlapping constituent elements are not repeatedly described.

First Embodiment

FIG. 1 is a vertical cross-sectional diagram of an entire image forming apparatus 1 according to a first embodiment. For example, the image forming apparatus 1 is a multi-function peripheral (MFP). However, the image forming apparatus 1 is not limited to the example described above, and may be a copy machine, a printer, or the like. The image forming apparatus 1 according to the first embodiment has a decoloring function as will be described below. For this reason, the image forming apparatus 1 is an example of a "decoloring apparatus".

As illustrated in FIG. 1, the image forming apparatus 1 includes a case 11, a scanning unit 12, a paper feeding unit 13, a printing unit 14, a paper discharge unit 15, a control panel 16, and a control unit 17.

The case 11 is formed around an edge of the image forming apparatus 1. The case 11 accommodates the scanning unit 12, the paper feeding unit 13, the printing unit 14, and the control unit 17.

The scanning unit 12 reads image information of a document, and generates digital data corresponding to the read image.

The paper feeding unit 13 supplies a sheet S to the printing unit 14.

The printing unit 14 forms an image on the sheet S based on image data.

The paper discharge unit 15 discharges the sheet S, on which the image is formed by the printing unit 14, onto a discharge tray 15*t* by a discharge roller 15*r*.

The control panel 16 receives input of various operation instructions by a user.

The control unit 17 controls the entire image forming apparatus 1. For example, the control unit 17 controls operation of each of the scanning unit 12, the paper feeding unit 13, the printing unit 14, and the control panel 16.

Next, a configuration of each unit of the image forming apparatus 1 is described.

First, the printing unit 14 is described.

According to the first embodiment, for convenience of description, the printing unit 14 that is an intermediate transfer type is taken as an example for description. However, it is also possible that a configuration according to the first embodiment applies to an image forming apparatus that has a printing unit which is a direct transfer type. The printing unit 14 has an intermediate transfer unit 21, a secondary transfer unit 22, a fixing device 23, a first transportation path 24, and a second transportation path 25.

The intermediate transfer unit 21 has an intermediate transfer belt 31, a plurality of rollers 32*a*, 32*b*, 32*c*, and 32*d*, and a plurality of image forming units 33Y, 33M, 33C, 33K, and 33E.

The intermediate transfer belt 31 is formed in the form of an endless loop. The plurality of rollers 32*a*, 32*b*, 32*c*, and 32*d* support the intermediate transfer belt 31. Accordingly, it is possible that the intermediate transfer belt 31 runs endlessly in a direction that is indicated by an arrow m in FIG. 1.

The plurality of image forming units 33Y, 33M, 33C, 33K, and 33E include a yellow image forming unit 33Y, a magenta image forming unit 33M, a cyanogen image forming unit 33C, a black image forming unit 33K, and a decolorable-image forming unit 33E, respectively. Each of the image forming units 33Y, 33M, 33C, 33K, and 33E has a photoconductive drum 33*a*, an electrostatic charger 33*b*, a light exposure unit 33*c*, a developing unit 33*d*, and a transfer roller 33*e*. Each of the image forming units 33Y, 33M, 33C, 33K, and 33E transfers a toner image that is formed on a surface of the photoconductive drum 33*a*, to the intermediate transfer belt 31 for the first transfer. The image forming units 33Y, 33M, 33C, 33K, and 33E have different colors of recording agents (e.g., toner), but have the same configuration.

At this point, the image forming apparatus 1 according to the first embodiment includes the decolorable-image forming unit 33E. The decolorable-image forming unit 33E transfers the toner image formed using a decolorable toner, to the intermediate transfer belt 31. The decolorable toner is decolored by receiving energy from the outside. For example, the decolorable toner is decolored by being affected by an external stimulus, such as a temperature, a specific wavelength light, or pressure, as the energy from the outside. The "decoloring" according to the first embodiment means that an image which is formed with colorant (including colorant in achromatic colors, such as white and black, as well as chromatic colors) different from a base color of the sheet becomes visually unrecognizable.

The secondary transfer unit 22 has a transfer roller 22*a*. The transfer roller 22*a* comes into contact with an outer circumferential surface of the intermediate transfer belt 31. One belt roller 32*a* that supports the intermediate transfer belt 31 is included in the secondary transfer unit 22. The sheet S, along with the intermediate transfer belt 31, is interposed between the transfer roller 22*a* and the belt roller 32*a*. Accordingly, the toner image on the intermediate transfer belt 31 is transferred onto the sheet S (i.e., secondary transfer is performed).

The fixing device 23 has a heating roller 23*a* and a pressing roller 23*b*. The heating roller 23*a* is controlled to be at a fixing temperature suitable for fixing the toner image, by the control unit 17. The pressing roller 23*b* faces the heating roller 23*a* across the first transportation path 24 so that the pressing roller 23*b* and the heating roller 23*a* can sandwich the sheet S therebetween. The fixing device 23 applies heat and pressure to the sheet S that passes between the heating roller 23*a* and the pressing roller 23*b*. Accordingly, the toner image that is transferred to the sheet S is fixed to the sheet S.

The image forming apparatus 1 according to the first embodiment has the decoloring function in which an image formed with the decolorable toner on the sheet S becomes visually unrecognizable. If the image forming apparatus 1 enters a decoloring mode in which an image on the sheet S is decolored, the control unit 17 controls the fixing device 23 in such a manner that the heating roller 23*a* is heated to a decoloring temperature higher than the fixing temperature of the decolorable toner. The decoloring temperature is a temperature at which the image that is printed with the decolorable toner becomes visually unrecognizable by applying energy that is at a given level or higher to the sheet S that passes through the fixing device 23. The fixing device 23 applies the energy to the sheet S by heating the sheet S that passes between the heating roller 23*a* and the pressing roller 23*b*. Accordingly, the image that is formed with the decolorable toner can be decolored.

The first transportation path 24 reaches the paper discharge unit 15 from the paper feeding unit 13 through the secondary transfer unit 22 and the fixing device 23. The sheet S moves to the paper discharge unit 15 from the paper feeding unit 13 through the secondary transfer unit 22 and the fixing device 23 by being transported along the first transportation path 24. On the other hand, the sheet S is transported along the second transportation path 25 when performing printing on both surfaces of the sheet S.

Next, the control panel 16 is described.

The control panel 16 has a display unit 16*a* and an input reception unit 16*b*. The display unit 16*a* includes a display screen D. Various elements of information are displayed on the display screen D. The input reception unit 16*b* includes a plurality of buttons. The input reception unit 16*b* receives input of various elements of operation instructions. However, the input reception unit 16*b* may be realized as a touch panel (a touch sensor) that is provided to the display screen D.

Next, the control unit 17 is described.

Figure 2:
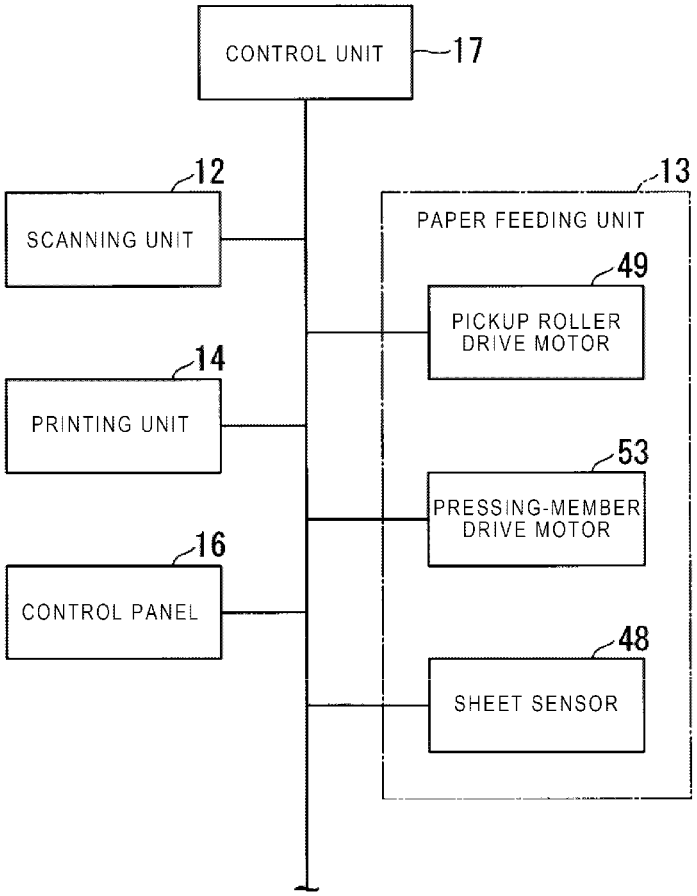
FIG. 2 is a block diagram illustrating a configuration of the image forming apparatus according to the embodiment.

FIG. 2 is a block diagram illustrating a systematic configuration of the image forming apparatus 1.

As illustrated in FIG. 2, the control unit 17 is connected electrically to the scanning unit 12, the paper feeding unit 13, the printing unit 14, and the control panel 16 through an electric connection path such as a cable.

One or several portions of, or all portions of the control unit 17, for example, are software functional units that are realized by a processor, such as a central processing unit (CPU), executing a program that is stored in a memory of the image forming apparatus 1. However, one or several portions of, or all portions of the control unit 17, for example, may be realized by hardware items, such as a large scale integration (LSI), an application specific integrated circuit (ASIC), or a field-programmable gate array (FPGA), and may be realized by a combination of a software functional unit and a hardware item.

Next, the paper feeding unit 13 is described.

As illustrated in FIG. 1, the paper feeding unit 13 of the image forming apparatus 1 includes a plurality of paper feeding units, paper feeding units 40A, 40B, and 40C. It is possible that the plurality of paper feeding units, the paper feeding units 40A, 40B, and 40C accommodate a plurality of sheets S, respectively, independently of each other. The plurality of paper feeding units, the paper feeding units 40A, 40B, and 40C have the same configuration. For this reason, in the following description, if there is no need to distinguish among the plurality of paper feeding units, the paper feeding units 40A, 40B, and 40C, the paper feeding units 40A, 40B, and 40C are referred to simply as a paper feeding unit 40. According to the first embodiment, each of the paper feeding units 40A, 40B, and 40C has a pressing member 46 and a pressing-member drive mechanism 47 that will be described below (refer to FIG. 5). However, the pressing member 46 and the pressing-member drive mechanism 47 do not need to be provided to all of the paper feeding units 40A, 40B, and 40C. For example, the pressing member 46 and the pressing-member drive mechanism 47 may be provided to at least one paper feeding unit 40, among the plurality of paper feeding units, the paper feeding units 40A, 40B, and 40C.

Figure 3:
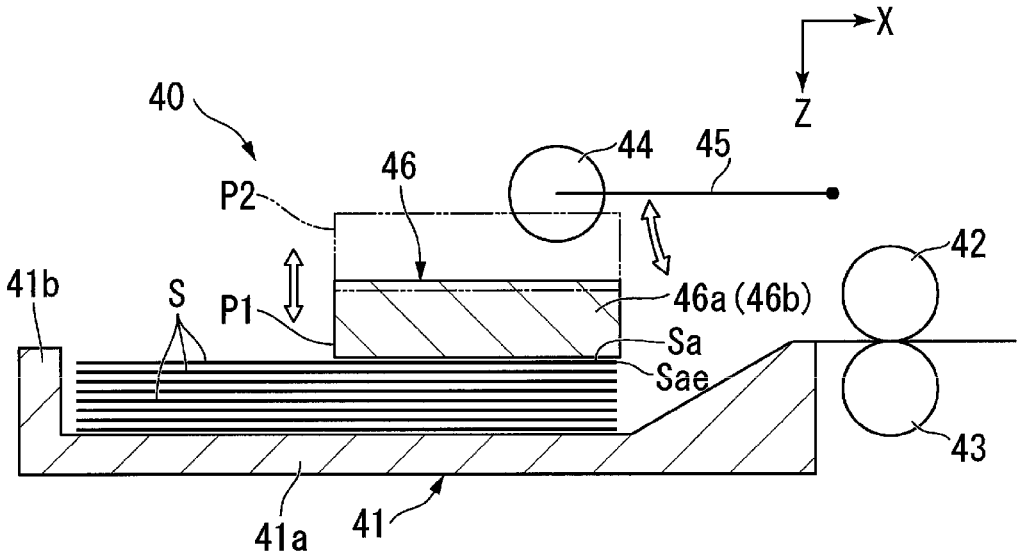
FIG. 3 is a cross-sectional diagram illustrating a paper feeding unit according to the embodiment.

FIG. 3 is an exploded cross-sectional diagram illustrating one paper feeding unit 40.

As illustrated in FIG. 3, the paper feeding unit 40 has a paper feeding cassette 41, a paper feeding roller 42, a separation roller 43, a pickup roller 44, a pickup roller drive mechanism 45, the pressing member 46, the pressing-member drive mechanism 47 (refer to FIG. 5), and a sheet sensor 48 (refer to FIG. 2).

The paper feeding cassette 41 is an example of an "accommodation unit". The paper feeding cassette 41 has a bottom wall 41*a* and a side wall 41*b* that rises up from a peripheral edge of the bottom wall 41*a*, and thus is formed to have a concave shape, resulting in being open at the top. The paper feeding cassette 41 is attached to the case 11 in a detachable manner. The plurality of sheets S is accommodated in the paper feeding cassette 41. For example, sheets, which have been processed for reuse (hereinafter, referred to as "sheet(s) of reuse"), are accommodated in the paper feeding cassette 41. An example of the sheet of reuse paper is a sheet on which an image formed with the decolorable toner is decolored.

The paper feeding roller 42 and the separation roller 43 are arranged more downstream than the paper feeding cassette 41 in a transportation direction X (referred to simply as a "sheet transportation direction X") of the sheet S that is transported from the paper feeding cassette 41. Each of the paper feeding roller 42 and the separation roller 43 is driven by a motor that is not illustrated. The paper feeding roller 42 feeds the sheet S that is supplied from the paper feeding cassette 41, to the first transportation path 24. If two sheets S are supplied to be transported from the paper feeding cassette 41, the separation roller 43 returns the below-positioned sheet S of the two sheets S to the paper feeding cassette 41.

The pickup roller 44 is positioned over the paper feeding cassette 41. The pickup roller 44 is positioned more upstream in the sheet transportation direction X than the paper feeding roller 42. The pickup roller 44 comes into contact with the uppermost sheet S from above, among the plurality of sheets S that are accommodated in the paper feeding cassette 41. The pickup roller 44 is driven by a pickup drive motor 49 (refer to FIG. 2). The pickup roller 44 picks up and feeds the uppermost sheet S, among the plurality of sheets S that are accommodated in the paper feeding cassette 41, toward the paper feeding roller 42.

If the paper feeding cassette 41 is detached from the case 11, the pickup roller drive mechanism 45 causes the pickup roller 44 to be retracted upward. On the other hand, if the paper feeding cassette 41 is closed with respect to the case 11, the pickup roller drive mechanism 45 causes the pickup roller 44 to descend toward the uppermost sheet S.

The pressing member 46 is a member for uncurling a sheet S that is curled. The pressing member 46 is placed on the plurality of sheets S that are accommodated in the paper feeding cassette 41, and causes the plurality of sheets S to be pressed in a sheet thickness direction (a sheet mounting direction) Z. For example, the pressing member 46 is a weight member that presses the plurality of sheets S in the sheet thickness direction Z using a pressing member 46's own weight.

As illustrated in FIG. 3, the pressing member 46 at least presses downstream-side end portions Sa of the plurality of sheets S in the sheet transportation direction X, in the sheet thickness direction Z. For example, the pressing member 46 includes end portions (end portions 46*a* and 46*b*) that are positioned more downstream in the sheet transportation direction X than at least one portion of the pickup roller 44. The pressing member 46 presses the plurality of sheets S in the sheet thickness direction Z in a position that is more downstream in the sheet transportation direction X than at least one portion of the pickup roller 44. For example, the pressing member 46 presses leading ends Sae of the plurality of sheets S that are positioned downstream in the sheet transportation direction X, in the sheet thickness direction Z.

Figure 4:
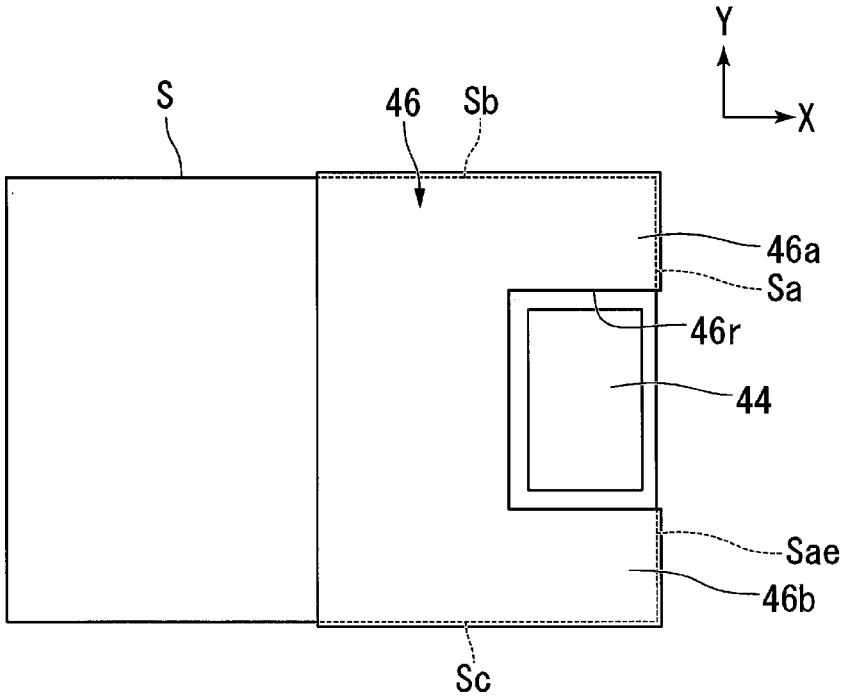
FIG. 4 is a plan diagram illustrating a pressing member according to the embodiment.

FIG. 4 is a plan diagram illustrating the pressing member 46.

As illustrated in FIG. 4, the pressing member 46 according to the first embodiment is formed in the form of a plate along an upper surface of the sheet S. For example, the pressing member 46 has a size that is large enough to cover approximately the downstream-side half of the plurality of sheets S in the sheet transportation direction X. Furthermore, the pressing member 46 has a width that extends between both flank-side portions (both end portions) Sb and Sc of the plurality of sheets S in a direction Y (hereinafter referred to as a "sheet width direction Y") that is orthogonal to the sheet transportation direction X. The pressing member 46 presses the downstream-side end portions Sa of the plurality of sheets S in the sheet transportation direction X, and at least one portion of each of the both flank-side portions Sb and Sc of the plurality of sheets S that run approximately in parallel with the sheet transportation direction X, integrally in the sheet thickness direction Z.

According to the first embodiment, the pressing member 46 has a concave portion 46*r* into which at least one portion (for example, all portions) of the pickup roller 44 can enter. In other words, the pressing member 46 has a pair of the end portions 46*a* and 46*b* that are positioned separately on both sides of the pickup roller 44, respectively, in the sheet width direction Y. In positions that are located on the both sides of the pickup roller 44 in the sheet width direction Y, the end portions 46*a* and 46*b* of the pressing member 46 press the downstream-side end portions Sa of the plurality of sheets S in the sheet transportation direction X, in the sheet thickness direction Z.

As illustrated in FIG. 3, the pressing member 46 is moved, by the pressing-member drive mechanism 47 that will be described below, between a pressing position P1 (a first position which is indicated by a solid line in FIG. 3) and a separated position P2 (a second position which is indicated by a two-dot chain line in FIG. 3). In the pressing position P1, the pressing member 46 comes into contact with the upper surface of the uppermost sheet S from above, among the plurality of sheets S that are accommodated in the paper feeding cassette 41, and thus presses the plurality of sheets S in the sheet thickness direction Z. When the pressing member 46 is present in the pressing position P1, the plurality of sheets S are pressed in the sheet thickness direction Z, and thus the sheet S that is curled is uncurled by the pressing force of the pressing member 46. On the other hand, in the separated position P2, the pressing member 46 is moved upward from the pressing position P1, and thus is separated from the plurality of sheets S. When the pressing member 46 is present at the separated position P2, the pickup roller 44 and the paper feeding roller 42 can feed the sheet S from the paper feeding cassette 41 toward the printing unit 14, without being obstructed by the pressing member 46.

Figure 5:
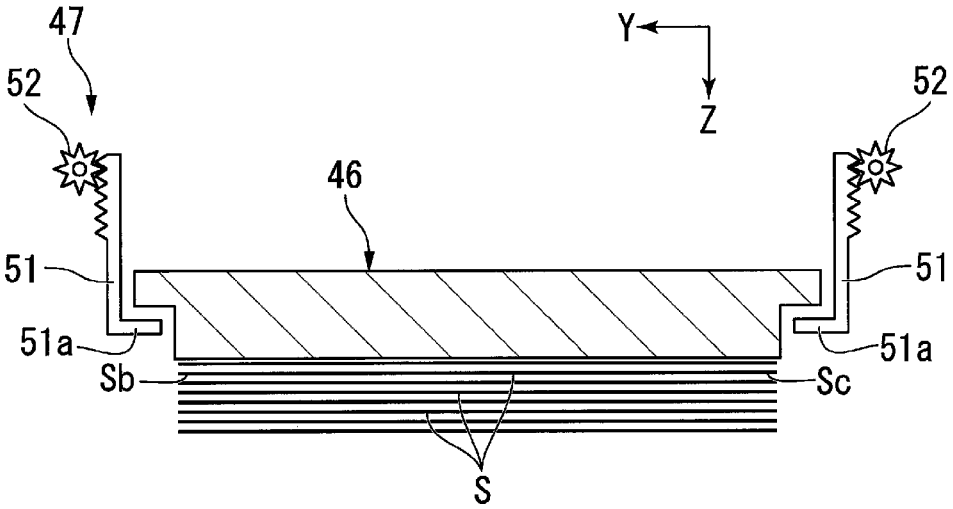
FIG. 5 is a cross-sectional diagram illustrating the pressing member and a pressing-member drive mechanism according to the embodiment.

FIG. 5 is a cross-sectional diagram illustrating the pressing-member drive mechanism 47 according to the first embodiment.

As illustrated in FIG. 5, the pressing-member drive mechanism 47 has a support member 51, a transmission mechanism 52, and a pressing-member drive motor 53 (refer to FIG. 2).

The support member 51 has a hooking portion 51*a* that faces a portion of the pressing member 46 from below. If the pressing member 46 is present in the pressing position P1, the hooking portion 51*a* is separated from the pressing member 46, in such a manner that the pressing member 46 applies a force to the plurality of sheets S using the pressing member 46's own weight. On the other hand, if the pressing member 46 is caused to be moved from the pressing position P1 to the separated position P2, the hooking portion 51*a* is brought into contact with one portion of the pressing member 46 from below.

The transmission mechanism 52, for example, includes a rack that is provided to the support member 51 and a pinion gear that is rotated by the pressing-member drive motor (hereinafter referred to simply as a "drive motor") 53. With the rotation by the drive motor 53, the transmission mechanism 52 causes the support member 51 to be moved upward or downward.

The drive motor 53 causes the support member 51 to be moved downward through the transmission mechanism 52, and thus causes the pressing member 46 to be moved to the pressing position P1. On the other hand, the drive motor 53 causes the support member 51 to be moved upward through the transmission mechanism 52, and thus causes the pressing member 46 to be moved to the separated position P2.

However, a configuration of the pressing-member drive mechanism 47 is not limited to the example described above. For example, instead of employing the configuration described above, the pressing-member drive mechanism 47 may be a drive mechanism that moves the pressing member 46 upward or downward using a ball screw, a link mechanism, an eccentric cam, a solenoid, or the like. The drive motor 53 or the solenoid is an example of a "drive source" that causes the pressing member 46 to be moved.

The sheet sensor 48 (refer to FIG. 2) is provided to the paper feeding cassette 41. The sheet sensor 48 detects the presence and absence of the sheet S that is accommodated in the paper feeding cassette 41. For example, the sheet sensor detects that the sheet S is accommodated, based on an amount of operation of a sheet lift mechanism that lifts the sheet S toward the pickup roller 44. However, the sheet sensor 48 is not limited to the example described above, and may be an optical-type of sensor or any other type of sensor. The sheet sensor 48 sends a detection result thereof to the control unit 17.

If the sheet S is accommodated in the paper feeding cassette 41, based on the result of the detection by the sheet sensor 48, the control unit 17 recognizes that the sheet S is accommodated in the paper feeding cassette 41. Furthermore, if the sheet S is supplied from the paper feeding cassette 41 toward the printing unit 14, the control unit 17 controls the pressing-member drive mechanism 47 in such a manner that the pressing member 46 is moved to the separated position P2. On the other hand, if the sheet S is not supplied from the paper feeding cassette 41 toward the printing unit 14, the control unit 17 controls the pressing-member drive mechanism 47 in such a manner that the pressing member 46 is moved to the pressing position P1. For example, in the plurality of paper feeding units, the paper feeding units 40A, 40B, and 40C, not only does the control unit 17 cause the pressing member 46 of the paper feeding cassette 41 from which the sheet S is supplied toward the printing unit 14, to be moved to the separated position P2, but also causes the pressing member 46 of the paper feeding cassette 41 from which the sheet S is not supplied toward the printing unit 14, to be moved to the pressing position P1.

Next, an example of a flow for processing by the control unit 17 according to the first embodiment is described.

Figure 6:
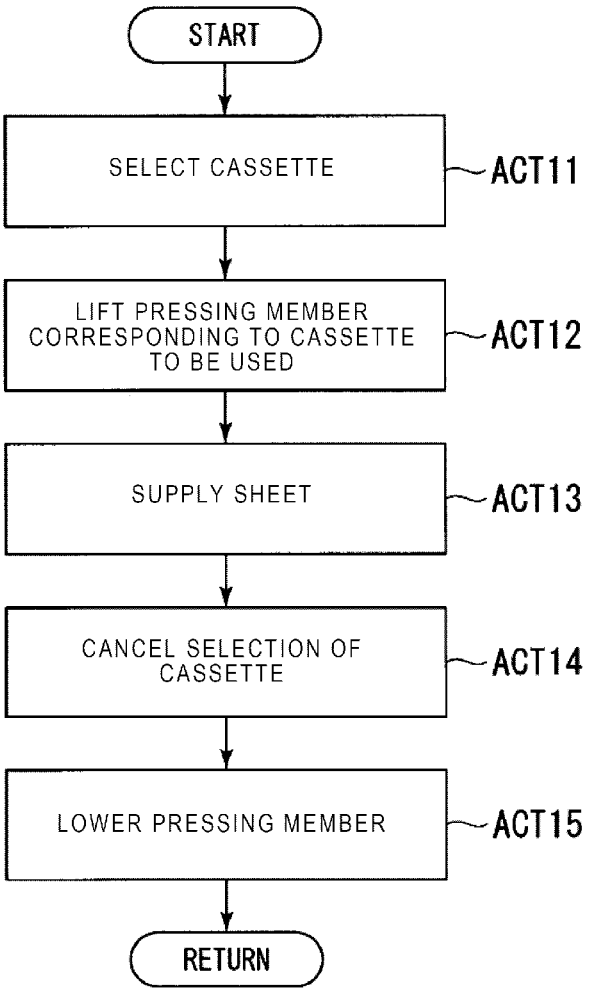
FIG. 6 is a flowchart illustrating an example of a flow for processing by a control unit according to the embodiment.

FIG. 6 is a flowchart illustrating an example process carried out by the control unit 17. FIG. 6 illustrates an example in which the paper feeding cassette 41 to be used for printing is selected and then the pressing member 46 of the selected paper feeding cassette 41, is moved to the separated position P2.

According to the first embodiment, if the paper feeding cassette 41 is closed with respect to the case 11, the control unit 17 causes the pressing member 46 of the paper feeding cassette 41, to be moved to the pressing position P1. Accordingly, if the sheet S that is accommodated in the paper feeding cassette 41 is curled, the sheet S that is curled is uncurled by an effect of the pressing force by the pressing member 46.

If printing is performed in the image forming apparatus 1, the control unit 17 receives an input indicating a selection of the paper feeding cassette 41 to be used for printing (ACT 11). The "paper feeding cassette to be used" means the paper feeding cassette 41 from which the sheet S is supplied to the printing unit 14, in a plurality of paper feeding cassettes 41 that are included in the plurality of paper feeding units, the paper feeding units 40A, 40B, and 40C. For example, based on an instruction that is input by a user through the input reception unit 16*b* of the control panel 16, or on a print instruction from an external apparatus (for example, a computer that is operated by a user), the control unit 17 selects the paper feeding cassette 41 that is to be used, from among the plurality of paper feeding cassettes 41. However, the paper feeding cassette 41 to be used may be set by default.

If the paper feeding cassette 41 to be used is selected, the control unit 17 causes the pressing member 46 of the paper feeding cassette 41 to be used, to be moved from the pressing position P1 to the separated position P2 (ACT 12). Then, in a state where the pressing member 46 is positioned in the separated position P2, the control unit 17 drives the pickup roller 44 and the paper feeding roller 42, and thus supplies the sheet S from the paper feeding cassette 41 to be used, toward the printing unit 14 (ACT 13). Accordingly, based on the instruction that is input through the input reception unit 16*b* of the control panel 16, or on the print instruction from the external apparatus, the printing is performed on the sheet S that is supplied from the paper feeding cassette 41, in the printing unit 14.

On the other hand, while the printing is performed, the control unit 17 maintains the pressing member 46 of the paper feeding cassette 41 not to be used (the paper feeding cassette that is not selected), in the pressing position P1. Accordingly, if the sheet S that is accommodated in the paper feeding cassette 41 not to be used is curled, the sheet S that is curled is uncurled by the pressing force of the pressing member 46.

When the printing that is based on the instruction that is input through the input reception unit 16*b* of the control panel 16, or on the print instruction from the external apparatus is terminated, the control unit 17 cancels the selection of the paper feeding cassette 41 to be used (ACT 14). If the selection of the paper feeding cassette 41 to be used is canceled, the control unit 17 returns the pressing member 46 of the paper feeding cassette 41 in use, from the separated position P2 to the pressing position P1 (ACT 15). Accordingly, a processing sequence is terminated. Subsequently, based on a next instruction that is input through the input reception unit 16*b* of the control panel 16, or on a next print instruction from the external apparatus, the control unit 17 repeats processing in each of ACT 11 to ACT 15.

Next, another example process carried out by the control unit 17 according to the first embodiment is described.

Figure 7:
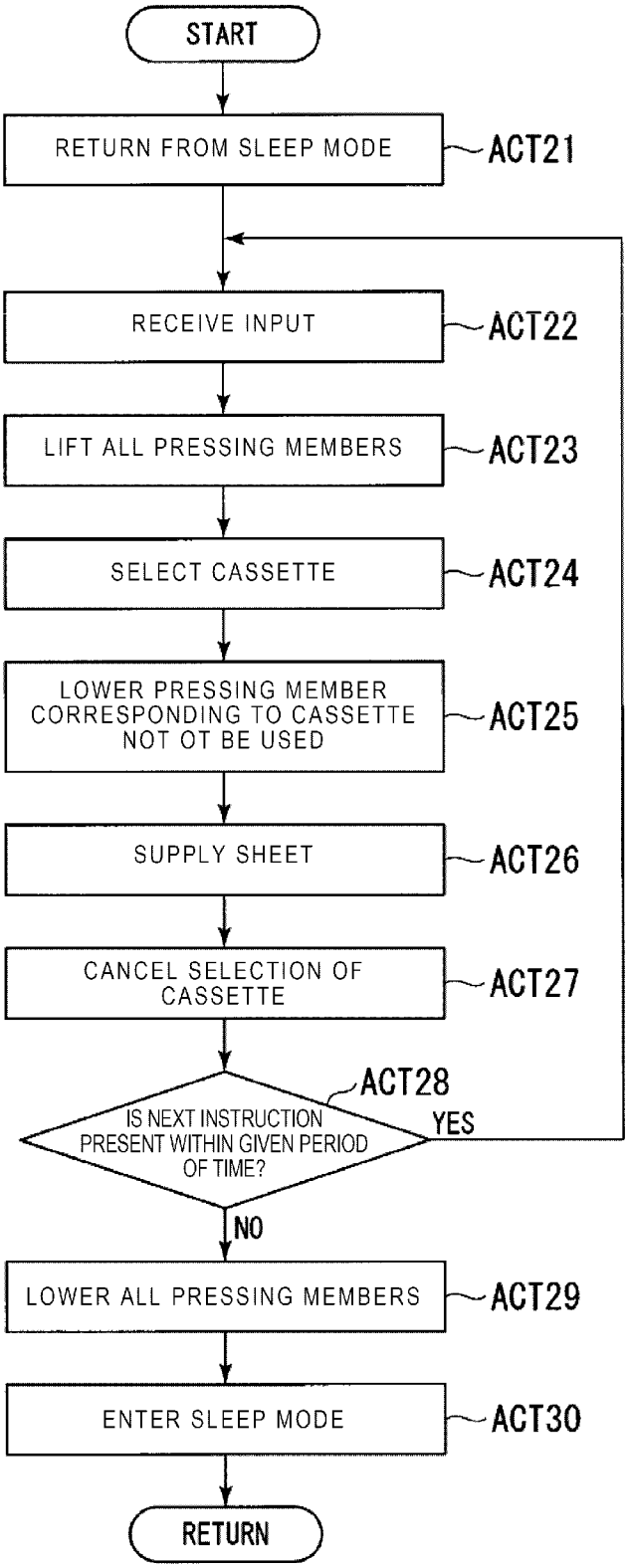
FIG. 7 is a flowchart illustrating another example of the flow for the processing by the control unit according to the embodiment.

FIG. 7 is a flowchart illustrating another example process carried out by the control unit 17. FIG. 7 illustrates an example in which if a state where the paper feeding cassette 41 can be selected is reached, all pressing members 46 of the paper feeding cassette 41 that can be selected, are moved in advance to the separated position P2. At this point, an example is taken in which input of an operation instruction is performed through the input reception unit 16*b* of the control panel 16. In this case, in an initial stage of the input of the operation instruction, a time span during which it is unclear which paper feeding cassette 41 in the plurality of paper feeding cassettes 41 that are included in the plurality of paper feeding units, the paper feeding units 40A, 40B, and 40C, is selected is present.

At this point, several operation modes for the image forming apparatus 1 are defined. For example, the operation modes for the image forming apparatus 1 include a "normal mode", a "standby mode", and a "sleep mode".

The "normal mode" is a mode in which a temperature of the fixing device 23 is maintained at the fixing temperature and information is displayed on the display screen D of the display unit 16*a*. For example, the normal mode is a mode that is maintained in the middle of performing the printing in the image forming apparatus 1 immediately after the instruction is input through the input reception unit 16*b* of the control panel 16, or that is maintained immediately after the printing is completed, and so on.

The "standby mode" is a mode in which the temperature of the fixing device 23 is maintained at the fixing temperature but the display screen D of the display unit 16*a* is powered off. For example, the standby mode is a mode that is entered if operation on the input reception unit 16*b* of the control panel 16 is not performed after a first given time that is set in advance is exceeded. The standby mode may be referred to as a "first power saving mode."

The "sleep mode" is a mode in which the display screen D of the display unit 16*a* is also powered off without the temperature of the fixing device 23 being maintained at the fixing temperature. For example, the sleep mode is a mode that is entered if there is no operation input to the input reception unit 16*b* of the control panel 16 and there is no print instruction to the image forming apparatus 1 from the external apparatus after a second given time that is set in advance is exceeded. The sleep mode may be referred to as a "second power saving mode, or a "rest mode". The second given time is a time that is longer than the first given time.

As illustrated in FIG. 7, for example, in a state where the image forming apparatus 1 is in the sleep mode, if there is an operation on the input reception unit 16*b* of the control panel 16, the control unit 17 causes the image forming apparatus 1 to return from the sleep mode to the normal mode (ACT 21). Then, the control unit 17 receives an instruction that is input through the input reception unit 16*b* of the control panel 16 (ACT 22).

In the present example, if it is unclear which paper feeding cassette 41 is selected among the plurality of paper feeding cassettes 41 that are included in the plurality of paper feeding units, the paper feeding units 40A, 40B, and 40C (that is, if a state where any one of the plurality of paper feeding cassettes 41 can be selected is attained), the control unit 17 causes all pressing members 46 of the plurality of paper feeding cassettes 41 that can be selected, to be moved from the pressing position P1 to the separated position P2 (ACT 23). Then, the control unit 17 receives an input indicating a selection of the paper feeding cassette 41 to be used for printing (ACT 24). Then, based on the instruction that is input through the input reception unit 16*b* of the control panel 16, the control unit 17 selects the paper feeding cassette 41 to be used, from among the plurality of paper feeding cassettes 41.

If the paper feeding cassette 41 to be used is selected, the control unit 17 returns the pressing member 46 of the paper feeding cassette 41 not to be used (the paper feeding cassette 41 that is not selected), from the separated position P2 to the pressing position P1 (ACT 25). Accordingly, if the sheet S that is accommodated in the paper feeding cassette 41 not to be used is curled, the sheet S that is curled is uncurled by the pressing force of the pressing member 46.

Then, in a state where the pressing member 46 of the paper feeding cassette 41 to be used, is positioned in the separated position P2, the control unit 17 drives the pickup roller 44 and the paper feeding roller 42, and thus supplies the sheet S from the paper feeding cassette 41 to be used, toward the printing unit 14 (ACT 26). Accordingly, based on the instruction that is input through the input reception unit 16*b* of the control panel 16, the printing is performed on the sheet S that is supplied from the paper feeding cassette 41, in the printing unit 14.

When the printing that is based on the instruction that is input by a user through the input reception unit 16*b* of the control panel 16 is terminated, the control unit 17 cancels the selection of the paper feeding cassette 41 to be used (ACT 27). Then, the control unit 17 detects whether or not input of a next instruction to the image forming apparatus 1 through the input reception unit 16*b* of the control panel 16 or a next print instruction from the external apparatus is performed during the second given time (ACT 28). For example, if the input of the next instruction to the image forming apparatus 1 through the input reception unit 16*b* of the control panel 16 is performed within the second given time (YES in ACT 28), the control unit 17 repeats processing in each of ACT 22 to ACT 27.

On the other hand, if the input of the next instruction through the input reception unit 16*b* of the control panel 16 or the next print instruction from the external apparatus is not performed within the second given time (NO in ACT 28), the control unit 17 causes the image forming apparatus 1 to transition from the normal mode to the sleep mode. In the present example, if the image forming apparatus 1 transitions to the sleep mode, the control unit 17 causes all pressing members 46, which are included in all paper feeding units 40, to be moved to the pressing position P1 (ACT 29), and causes the image forming apparatus 1 to transition to the sleep mode (ACT 30). Accordingly, a processing sequence is terminated. Subsequently, based on the next instruction that is input through the input reception unit 16*b* of the control panel 16, the control unit 17 repeats the processing in each of ACT 21 to ACT 30 described above.

At this point, if the operation on the input reception unit 16*b* of the control panel 16 is not performed after the first given time is exceeded, the control unit 17 may cause the image forming apparatus 1 to transition to the standby mode. In the standby mode described above, the control unit may maintain a plurality of pressing members 46, which correspond to the plurality of paper feeding cassettes 41 that can be selected, in the separated position P2.

The example process carried out by the control unit 17 is described above. However, the processes carried out by the control unit 17 are not limited to the example described above. For example, if the paper feeding cassette 41 in which the sheet S is newly accommodated is detected by the sheet sensor 48, the control unit 17 may exclude the paper feeding cassette from the paper feeding cassettes 41 that are selection targets, in such a manner that that paper feeding cassette 41 is not used during a fixed period of time. Furthermore, based on a time series in which the sheets S are accommodated in the plurality of paper feeding cassettes 41, the control unit 17 may prioritize the plurality of paper feeding cassettes 41 and thus may select the paper feeding cassette 41 to be used. For example, the control unit 17 may raise the priority in selecting the paper feeding cassette 41 to be used, in order of increasing the time that elapses after the sheet S is accommodated in the paper feeding cassette 41.

With the image forming apparatus 1 having the configuration as described above, reduction in the occurrence of jams can be achieved. For example, under the influence of globalization or the like that occurred in the recent years, a sheet that is retained for a long time in an environment where temperature or humidity is not controlled is supplied to the image forming apparatus 1. Furthermore, from the perspective of environmental protection, the use of a sheet of reuse paper is requested. The sheet of reuse paper is already at least one time heated and pressurized. For this reason, in some cases, the sheet of reuse paper is comparatively greatly curled. In this manner, there is an increasing likelihood that the sheet S that is already in a curled state will be supplied to the image forming apparatus 1.

Thus, the image forming apparatus 1 according to the first embodiment includes the pressing member 46 that presses the plurality of sheets S, which are accommodated in the paper feeding cassette 41, in the sheet thickness direction Z. With this configuration, before the sheet S that is accommodated in the image forming apparatus 1 is used, the sheet S can be curled to a lesser extent by uncurling the sheet S in a flatten manner using the pressing member 46. At this point, according to the first embodiment, the pressing member 46 presses the downstream-side end portions Sa of the plurality of sheets S in the sheet thickness direction Z. Accordingly, the downstream-side end portion Sa of the sheet S, which is a leading end portion in the sheet transportation direction X is curled to a lesser extent and thus the sheet S is hard to hook onto a component that forms a transportation path. Accordingly, the reduction in the occurrence of jams can be effectively achieved. Furthermore, the downstream-side end portions Sa of the plurality of sheets S are pressed in the sheet thickness direction Z by the pressing member 46, and thus although a sheet of reuse paper that is already curled is accommodated, the sheet of reuse paper can be curled to a lesser extent.

According to the first embodiment, in addition to the downstream-side end portions Sa of the plurality of sheets S in the sheet transportation direction X, the pressing member 46 presses at least one portion of each of the both flank-side portions Sb and Sc of the plurality of sheets S that run approximately in parallel with the sheet transportation direction X, in the sheet thickness direction Z. With this configuration, because the both flank-side portions Sb and Sc of the sheet S can also be curled to a lesser extent, the sheet S is hard to hook onto the component that forms the transportation path. Accordingly, the reduction in the occurrence of jams can be further achieved.

According to the first embodiment, the pressing member 46 includes the end portions (for example, the end portions 46*a* and 46*b*) that are positioned more downstream in the sheet transportation direction X than at least one portion of the pickup roller 44. With this configuration, the end portion Sa of the sheet S that is the leading end portion in the sheet transportation direction X can be curled effectively to a much lesser extent. Accordingly, the reduction in the occurrence of jams can be further achieved.

According to the first embodiment, if the image forming apparatus 1 enters a power saving mode (for example, the sleep mode) in which the temperature of the fixing device 23 is not maintained at the fixing temperature, the control unit 17 causes the pressing member 46 to be moved to the pressing position P1. With this configuration, the sheet S can be curled to a lesser extent while the image forming apparatus 1 is in the power saving mode.

According to the first embodiment, if the sheet S that is decolored by the fixing device 23 is accommodated in the paper feeding cassette 41, the pressing member 46 presses the decolored sheet S in the sheet thickness direction Z. Accordingly, the sheet of reuse paper that has a likelihood of being already comparatively greatly curled can be curled to a lesser extent before the sheet S is used. Accordingly, the reduction in the occurrence of jams can be further achieved.

The example of the image forming apparatus 1 according to the first embodiment is described above. However, the configuration according to the first embodiment is not limited to the example described above. Several modification examples of the embodiment described above will be described below. It is noted that in each modification example, a configuration other than a configuration that will be described below is the same as the configuration according to the first embodiment, which is described above.

First Modification Example

Figure 8:
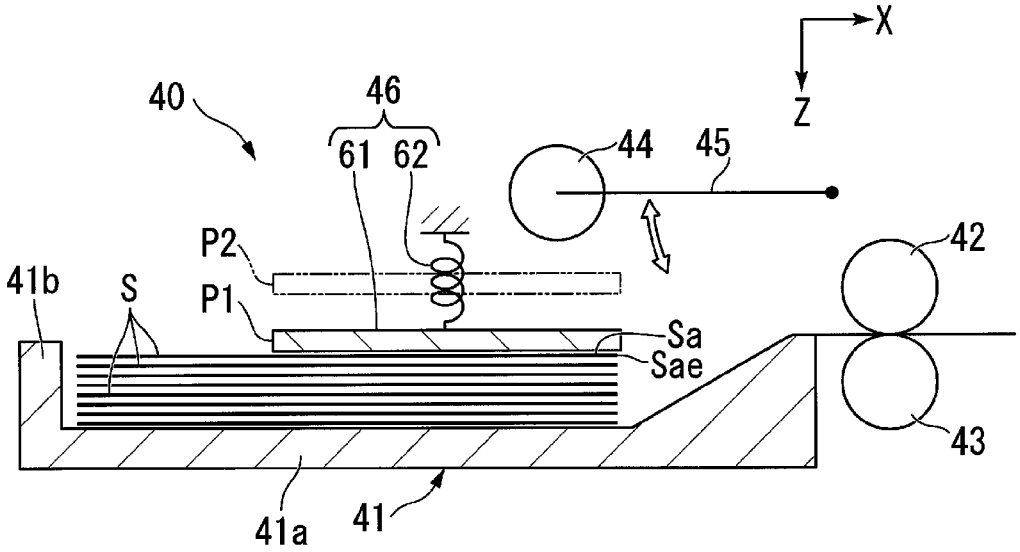
FIG. 8 is a cross-sectional diagram illustrating a paper feeding unit in a first modification example of the embodiment.

FIG. 8 is a cross-sectional diagram illustrating the paper feeding unit 40 of the image forming apparatus 1 in a first modification example.

As illustrated in FIG. 8, the pressing member 46 in the present modification example has a pushing plate 61 and a pushing spring 62. The pushing plate 61 has the same shape as the pressing member 46 according to the first embodiment, which is described above, when viewed from above. However, the pushing plate 61 is thin and light in comparison with the pressing member 46 according to the first embodiment, which is described above.

The pushing spring 62 applies pushing force to the pushing plate 61 to push against the plurality of sheets S. For this reason, if the pressing-member drive mechanism 47 does not cause force to be applied to the pushing plate 61, with the pushing force by the pushing spring 62, the pushing plate 61 is positioned in the pressing position P1. Accordingly, the pushing plate 61 presses the plurality of sheets S in the sheet thickness direction Z. On the other hand, the pressing-member drive mechanism 47 causes force, which acts against the pushing force by the pushing spring 62, to act on the pushing plate 61 and thus causes the pushing plate 61 to be moved from the pressing position P1 to the separated position P2. Accordingly, the pickup roller 44 and the paper feeding roller 42 can send the sheet S without being obstructed by the pushing plate 61.

Second Modification Example

Figure 9:
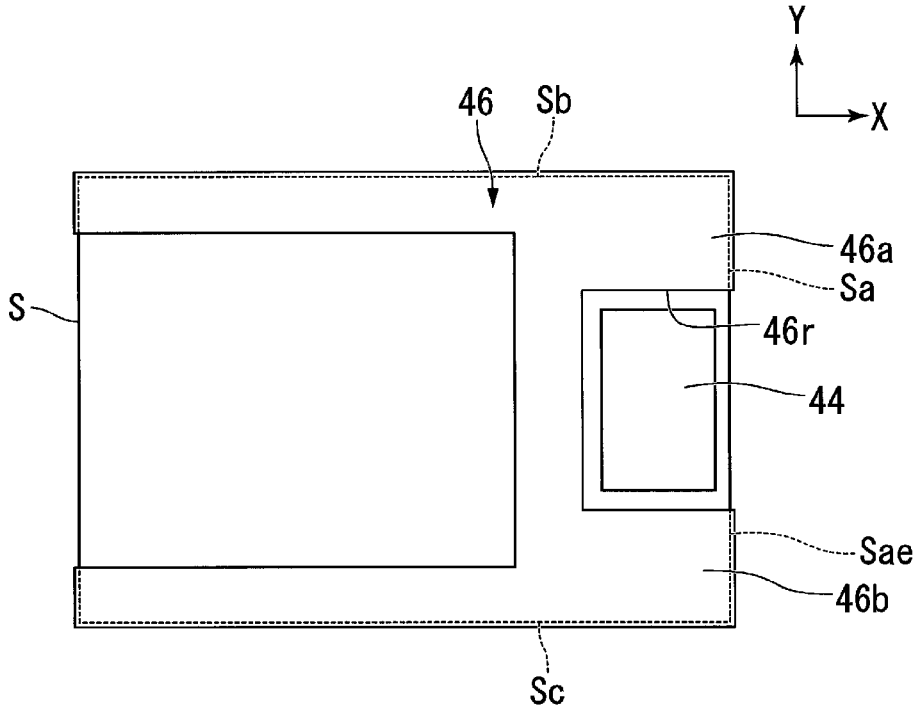
FIG. 9 is a plan diagram illustrating a pressing member in a second modification example of the embodiment.

FIG. 9 is a plan diagram illustrating the pressing member 46 of the image forming apparatus 1 in a second modification example.

As illustrated in FIG. 9, the pressing member 46 in the present modification example is formed in the shape of a letter U along the downstream-side end portion Sa of the sheet S in the sheet transportation direction X, and the both flank-side portions Sb and Sc of the sheet S. For example, the pressing member 46 presses the sheet S over entire lengths of the both flank-side portions Sb and Sc of the sheet S in the sheet transportation direction X. With this configuration, the both flank-side portions Sb and Sc of the sheet S can be curled to a much lesser extent. It is noted that the present modification example may find application in the pushing plate 61 in the first modification example described above, instead of the pressing member 46 according to the first embodiment, which is described above.

Third Modification Example

Figure 10:
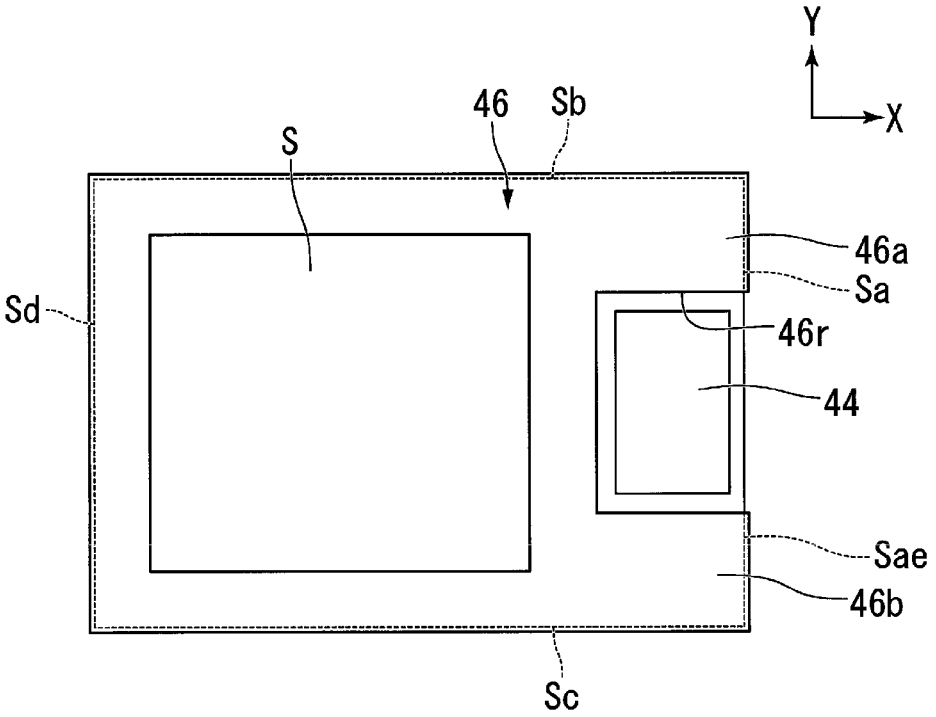
FIG. 10 is a plan diagram illustrating a pressing member in a third modification example of the embodiment.

FIG. 10 is a plan diagram illustrating the pressing member 46 of the image forming apparatus 1 in a third modification example.

As illustrated in FIG. 10, the pressing member 46 in the present modification example is formed in the shape of a frame along the downstream-side end portion Sa of the sheet S in the sheet transportation direction X, an upstream-side end portion Sd of the sheet S in the sheet transportation direction X, and the both flank-side portions Sb and Sc of the sheet S. With this configuration, the upstream-side end portion Sd of the sheet S can be curled to a lesser extent. When the upstream-side end portion Sd of the sheet S can be curled to a lesser extent, although a direction of transporting the sheet S is reversed at the time of duplex printing of the sheet S, the sheet S can be made hard to hook onto the component that forms the transportation path.

Second Embodiment

An image forming apparatus according to a second embodiment of the present invention is explained below.

The second embodiment is a modification of the first embodiment. In the following description of the second embodiment, components having functions same as those explained in the first embodiment are denoted by the same reference numerals and signs, and explanation of such components is repeated as needed.

Figure 11:
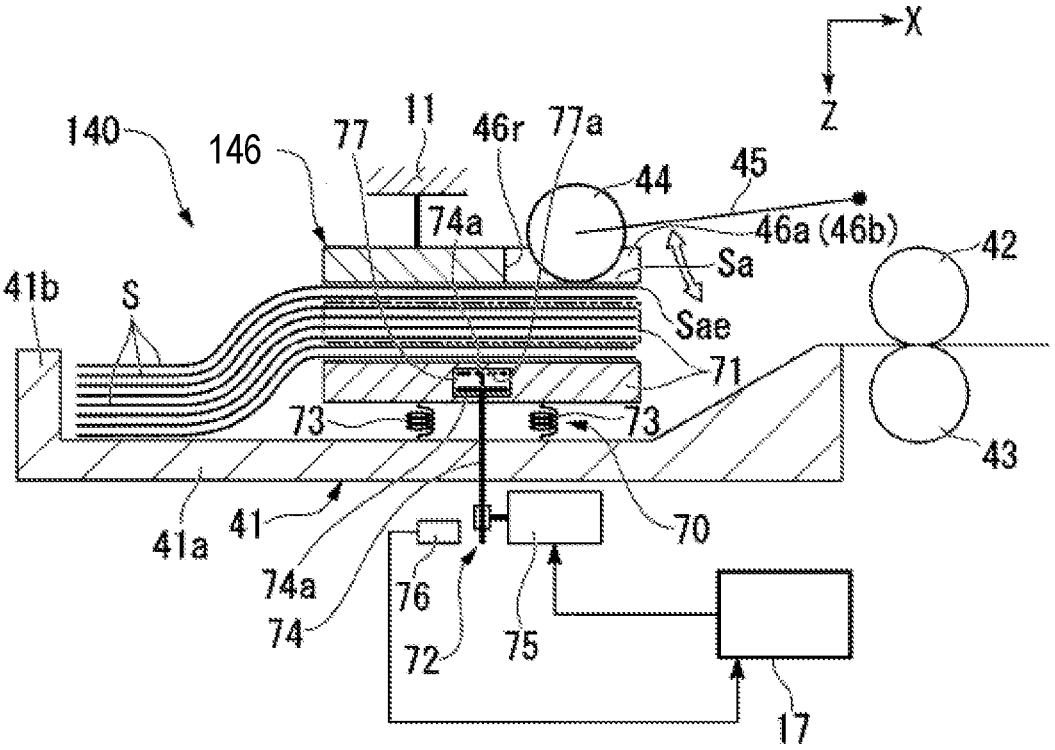
FIG. 11 is a cross-sectional diagram illustrating a paper feeding unit of an image processing apparatus according to the second embodiment.

FIG. 11 is a cross-sectional diagram illustrating a paper feeding unit 140 of an image processing apparatus according to the second embodiment. In the second embodiment, configuration of the image processing apparatus except for the paper feeding unit 140 is substantially the same as that of the image processing apparatus according to the first embodiment.

Specifically, in the first embodiment, the pressing-member drive mechanism 47 drives the pressing member 46 so that the pressing member 46 is moved between a pressing position P1 and a separated position P2. On the other hand, in the second embodiment, pressing force applied by the pressing member 46 is switched between two pressing states.

In detail, in the second embodiment, the pressing force by the pressing member 46, which is applied onto the downstream-side end portions Sa of a sheet S in the sheet transportation direction X, is switched between "pressing state" in which the pressing force by the pressing member 46 applied to the downstream-side end portions Sa exceeds a predetermined strength so that a curl of the sheet S is removed by being pressed by the pressing member 46 and "releasable state" in which the downstream-side end portions Sa is pressed by the pressing member 46 with pressing force weaker than that in the pressing state so that the sheet S can be fed by the pickup roller 44 even when the sheet S is pressed by the pressing member 46, by a switching mechanism 70 described below. The switching mechanism 70 is controlled by the control unit 17.

As illustrated in FIG. 11, the paper feeding unit 140 has a paper feeding cassette 41, a paper feeding roller 42, a separation roller 43, a pickup roller 44, a pickup roller drive mechanism 45, the pressing member 46, a sheet supporting member 71, and a push-up mechanism 72.

The paper feeding cassette 41 has a bottom wall 41*a* and a side wall 41*b* that rises up from a peripheral edge of the bottom wall 41*a*, and thus is formed to have a concave shape, resulting in being open at the top. A plurality of sheets S can be accommodated in the paper feeding cassette 41. For example, sheets of reuse paper are accommodated in the paper feeding cassette 41. An example of the sheet of reuse paper is a sheet on which an image formed with the decolorable toner is decolored.

The pressing member 46 according to the second embodiment is formed in the form of a plate along an upper surface of the sheet S. For example, the pressing member 46 has a size that is large enough to cover approximately the downstream-side half of the plurality of sheets S in the sheet transportation direction X. Furthermore, the pressing member 46 has a width that extends between both flank-side portions (both end portions) Sb and Sc of the plurality of sheets S in the sheet width direction Y. The pressing member 46 has a concave portion 46*r* into which at least one portion (for example, all portions) of the pickup roller 44 enters. In positions that are located to the both sides of the pickup roller 44 in the sheet width direction Y, the end portions 46*a* and 46*b* of the pressing member 46 press the downstream-side end portions Sa of the plurality of sheets S in the sheet transportation direction X, in the sheet thickness direction Z.

The sheet supporting member 71 is formed to support the lower surface of approximately the downstream-side half of the plurality of sheets S in the sheet transportation direction X. The sheet supporting member 71 is formed in the form of a plate having an approximately rectangular shape. Approximately the downstream-side half of the sheet S in the sheet transportation direction X is placed on the upper surface of the sheet supporting member 71. The sheet supporting member 71 is disposed inside the paper feeding cassette 41 so that the sheet supporting member 71 is movably supported in lifting/lowering direction.

For example, the push-up mechanism 72 includes springs 73, a lifting rod 74, a rod driving motor 75, and a position sensor 76.

The springs 73 are disposed between the lower surface of the paper feeding cassette 41 and the sheet supporting member 71, and biases the sheet supporting member 71 toward the upper direction.

One end of the lifting rod 74 is connected to the sheet supporting member 71 with slight allowance in up/down direction, and the other end is configured to receive a drive force from the rod drive motor 75 via a driving force transmission mechanism which is not illustrated. The lifting rod 74 supports the sheet supporting member 71 so that the height of the sheet supporting member 71 can be adjusted. For example, a contacting flange 74*a* is attached to the one end of the lifting rod 74. The contacting flange 74*a* is located within an allowance space 77 formed in the sheet supporting member 71, and is movably supported in the vertical direction within the range of the allowance space 77.

When the lifting rod 74 is lifted up to a height higher than predetermined height, an upper surface of the contacting flange 74*a* contacts with an upper inner wall 77*a* of the allowance space 77, and then, the sheet supporting member 71 is also lifted up according to the movement of the lifting rod 74. The rod drive motor 75 is controlled by the control unit 17 to lift up or lower the sheet supporting member 71 via the driving force transmission mechanism.

Position sensor 76 is disposed in adjacent to the lifting rod 74, and detects the height of the lifting rod 74 (i.e., the height of the sheet supporting member 71). The position sensor 76 generates detection signals corresponding to the height of the lifting rod 74 based on a detection result and out put the detection signals to the control unit 17.

The control unit 17 controls the rod drive motor 75 based on the detection signals output from the position sensor 76.

When the sheet S is fed from the paper feeding cassette 41 to the printer, the control unit 17 controls the rod drive motor 75 so that the height of the sheet supporting member 71 is adjusted according to the detection signals output from the position sensor 76 and the number of the sheets S which are fed from the paper feeding cassette 41.

Specifically, when the sheet S is fed from the paper feeding cassette 41 to the printer, the sheet supporting member 71 pushes up the lower surface of approximately the downstream-side half of the sheet S in the sheet transportation direction X to press the upper surface of an uppermost sheet against the lower surface of the pressing member 146 and the pickup roller 44 with pressing force weaker than a predetermined strength. That is, the plurality of sheets S is pressed against the lower surface of the pressing member 146 and the pickup roller 44 by the sheet supporting member 71 which is being pushed up with the springs 73. The pressing member 146, which is fixed on the inner wall of the case 11, presses the upper surface of the downstream-side end Sa of sheets S in the sheet transportation direction X with relatively weak pressing force so that the pressing member 146 allows the pickup roller 44 to feed the sheet S (releasable state).

In the image processing apparatus 1 according to the second embodiment, while the sheet S is fed, the sheet S is stably guided by the lower surface of the pressing member 146.

On the other hand, when the sheet S is not fed form the paper feeding cassette 41 to the printer, the height of the lifting rod 74 is adjusted by the control unit 17, so that the upper surface of the contacting flange 74*a* is pressed against the upper inner wall 77*a* of the allowance space 77, and then the plurality of the sheets S is pressed against the lower surface of the pressing member 146 and the pickup roller 44. Here, the pressing member 146, which is fixed on the inner wall of the case 11, pushes down the downstream-side end of the sheet S in the sheet transportation direction X toward the lower side (pressing state).

According to the second embodiment described above, the image forming apparatus includes the pressing member for pressing the downstream-side end portions of the plurality of sheets in the sheet transportation direction X, in the sheet thickness direction Z. In the image processing apparatus 1 according to the second embodiment, pressing force applied by the pressing member 146 is switched between two pressing states. When the sheet S is fed to the printer, the image processing apparatus 1 applies the pressing force by the pressing member 146 onto the sheets S weaker so that the pickup roller 44 can feed the sheet S while the sheet S is being pressed by the pressing member 146. When the sheet S is not fed to the printer, the image processing apparatus 1 cause the pressing member 46 to press the sheet S with higher pressing force in order to effectively remove the curl of the sheet S.

Therefore, the image processing apparatus 1 according to the second embodiment can remove the curl of the sheet S using the pressing member 146 while the sheet S is not fed, and stably guide the sheet S by the effect of the pressing member 146 while the sheet S is being fed.

As a result, according to the image processing apparatus, it is possible to reduce the occurrence of jams.

In addition, the image processing apparatus according to the second embodiment includes the sheet supporting member 71 for supporting the lower surface of approximately the downstream-side half of the plurality of sheets S in the sheet transportation direction X and the push-up mechanism 72 for pushing up the sheet supporting member 71 toward the upper direction.

By pushing up the sheet supporting member 71 by the push-up mechanism 72, it is possible to cause the upper surface of the plurality of the sheets accommodated in the paper feeding cassette 41 to contact with the pressing member 146, and adjust the pressing force applied onto the sheet S accommodated in the paper feeding cassette 41 by the switching mechanism 70.

In the second embodiment, the mechanism for adjusting the pressing force applied onto the sheet S accommodated in the paper feeding cassette 41 is located below the bottom surface of the sheet feeding unit 140. As a result of this configuration, it is possible to simplify the structure of the pressing member 146 which is located above the sheet S.

In the second embodiment, the switching mechanism 70 for switching the force applied by the pressing member 46 between the two pressing states is integrally disposed with the push-up mechanism 72, however, the switching mechanism 70 may be integrally disposed with the pressing member 146 which is located above the sheet S.

In the second embodiment, the pressing member 146 is fixed to the case 11 of the image processing apparatus 1, however, the pressing member 146 may be movably fixed to the case 11 using a retractable supporting mechanism so that the pressing member 146 can be retracted from the upper surface of the sheet S accommodated in the paper feeding cassette 41.

Modification Example of the Second Embodiment

Figure 12:
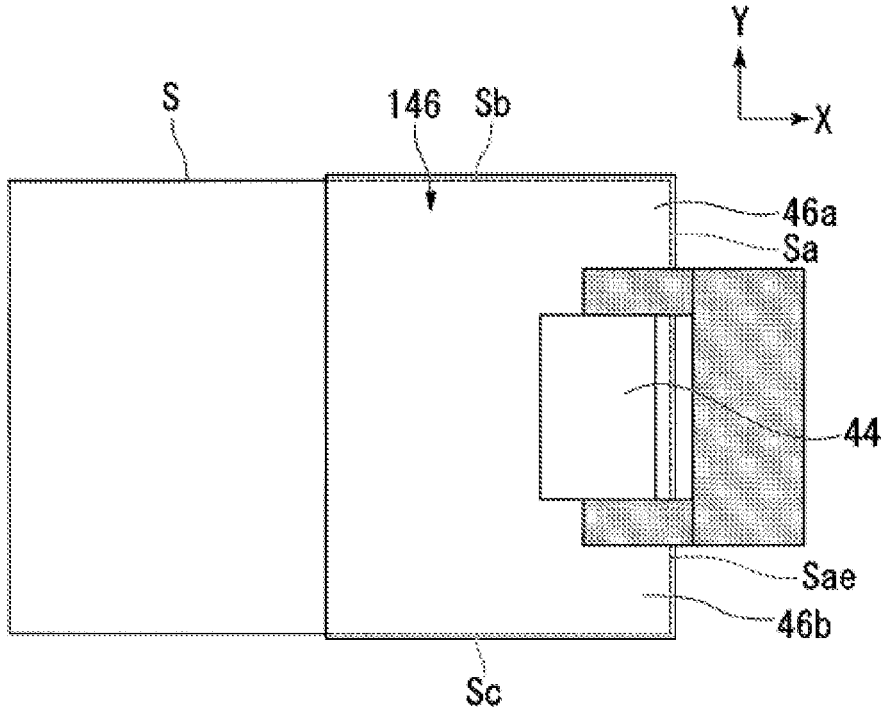
FIG. 12 is a plan diagram illustrating a pressing member of the image forming apparatus in a modification example of the second embodiment.
Figure 13:
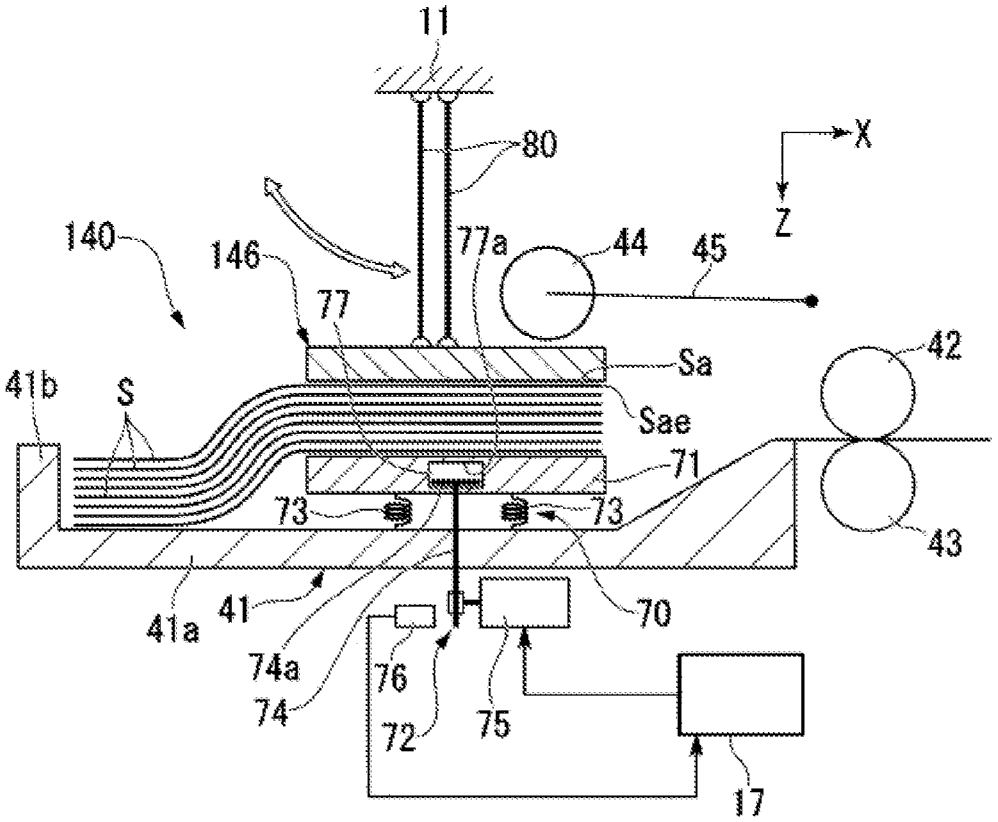
FIG. 13 is a cross-sectional diagram illustrating a paper feeding unit in the modification example of the second embodiment.

FIG. 12 is a plan diagram illustrating the pressing member 146 of the image forming apparatus in a modification example of the second embodiment. FIG. 13 is a cross-sectional diagram illustrating a paper feeding unit 140 in the modification example of the second embodiment.

As illustrated in FIG. 12, the pressing member 146 according to the second embodiment is formed in the form of a plate having an approximately rectangular shape. For example, the pressing member 146 has a size that is large enough to cover approximately the downstream-side half of the sheet S in the sheet transportation direction X. Furthermore, the pressing member 146 has a width that extends between both flank-side portions (both end portions) Sb and Sc of the plurality of sheets S in the sheet width direction Y. However, the pressing member 146 in this modification example does not have the concave portion 46*r* shown in the first embodiment.

The pressing member 146 in this modification example is movably supported by a link mechanism 80 such as parallel link mechanism, with regard to the case 11 of the image forming apparatus as shown in FIG. 13. The pressing member 146 is supported by the link mechanism 80 so that the pressing member 146 can be moved between a pressing position which is brought into contact with the upper surface of the plurality of sheets S and a non-contact position away from the upper surface of the plurality of sheets S. When the pressing member 146 is moved to the non-contact position from the pressing position, the pressing member 146 is moved toward upstream side in the sheet conveying direction and upper side. The link mechanism 80 is driven by a driver which is not illustrated.

In this modification example, when the sheet S is being fed from the paper feeding cassette 41 to the printer, the link mechanism 80 moves the pressing member 146 to the non-contact position, and push-up mechanism 72 causes the upper surface of the sheet S to contact with the pickup roller 44. Therefore, when the sheet S is being fed from the paper feeding cassette 41 to the printer, the pressing member 146 hardly becomes an obstacle for a sheet conveyance from the paper feeding cassette 41.

While the sheet S is not fed from the paper feeding cassette 41 to the printer, the pickup roller 44 is retracted from the upper surface of the sheet S toward upper side by the pickup roller drive mechanism 45. In a state that the pickup roller 44 is retracted, the pressing member 146 is moved to the pressing position by the link mechanism 80, and the sheet supporting member 71 is lifted up by the push-up mechanism 72 so that the pressing force by the pressing member 146 effectively removes the curl of the sheet S.

According to this modification example, it is possible to stably remove a curl of the sheet S by pressing the upper surface of approximately the downstream-side half of the plurality of sheets S in the sheet transportation direction X using the pressing member 146.

According to at least one embodiment described above, the image forming apparatus retains the pressing member that at least presses the downstream-side end portions of the plurality of sheets in the sheet transportation direction, in the sheet thickness direction, and thus can accomplish the reduction in the occurrence of jams.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a tray configured to accommodate a plurality of sheets which are conveyed out of the tray for printing;

a pickup roller configured to feed the sheets in the tray for printing;

a pressing member movable between a first position at which the pressing member presses the plurality of sheets against the tray and a second position at which the pressing member does not press the plurality of sheets against the tray, the pressing member including a portion that is positioned more downstream in a sheet conveying direction than at least one portion of the pickup roller;

a drive mechanism configured to cause the pressing member to be moved between the first and second positions; and a control unit configured to control the drive mechanism to move the pressing member into the first position, while a sheet is not supplied for printing from the tray and into the second position while the sheet is supplied for printing from the tray.

2. The apparatus according to claim 1, wherein the pressing member is positioned to press a downstream-side end of the sheets in the sheet conveying direction.

3. The apparatus according to claim 2, wherein in addition to the downstream-side end of the sheets, the pressing member presses at least one portion of each of both lateral-side portions of the sheets against the tray.

4. The apparatus according to claim 1, wherein the pressing member has a planar shape with a cutout section at a position of the pickup roller when the pickup roller feeds the sheets in the tray for printing.

5. The apparatus according to claim 4, wherein the pressing member has lateral portions that press against lateral sides of the sheets against the tray when the pressing member is in the first position.

6. The apparatus according to claim 5, wherein the pressing member has an edge portion that presses against an upstream-side end of the sheets against the tray when the pressing member is in the first position.

7. The apparatus according to claim 1, wherein the control unit controls the drive mechanism to move the pressing member to the first position, if the image forming apparatus enters a power saving mode.

8. The apparatus according to claim 1, further comprising:

a fixing device configured to be heated to a decoloring temperature at which an image that is printed with a decolorable toner becomes decolored, wherein, if a sheet that is decolored by the fixing device is accommodated in the tray, the pressing member presses the decolored sheet against the tray.

9. The apparatus according to claim 1, wherein the drive mechanism includes a rack connected to the pressing member and a pinion gear that engages the rack and moves the rack up and down as the pinion gear rotates.

10. An image forming apparatus comprising:

a tray configured to accommodate a plurality of sheets which are conveyed out of the tray for printing, the tray having a sheet support on which the sheets are stacked;

a pickup roller configured to feed the sheets in the tray for printing;

a plate member above the sheets, the plate member including a portion that is positioned more downstream in a sheet conveying direction than at least one portion of the pickup roller;

a drive mechanism configured to move the sheet support to press the sheets against a lower surface of the plate member; and a control unit configured to control the drive mechanism to move the sheet support in a direction towards the plate member, while a sheet is not supplied for printing from the tray.

11. The apparatus according to claim 10, wherein the sheet support is mounted on at least one spring that urges the sheets stacked on the sheet support to be pressed against the plate member with a first force even when the drive mechanism is not moving the sheet support in the direction towards the plate member, the first force being less than a second force applied against the plate member when the drive mechanism is moving the sheet support in the direction towards the plate member.

12. The apparatus according to claim 10, wherein the plate member is positioned to support a downstream-side end of the sheets in the sheet conveying direction when the sheets are pressed against the plate member by the sheet support.

13. The apparatus according to claim 10, wherein the plate member has a planar shape with a cutout section at a position of the pickup roller when the pickup roller feeds the sheets in the tray for printing.

14. The apparatus according to claim 13, wherein the plate member has lateral portions that support lateral sides of the sheets when the sheets are pressed against the plate member by the sheet support.

15. The apparatus according to claim 14, wherein the pressing member has an edge portion that supports an upstream-side end of the sheets when the sheets are pressed against the plate member by the sheet support.

16. The apparatus according to claim 10, wherein the control unit controls the drive mechanism to move the sheet support, if the image forming apparatus enters a power saving mode.

17. The apparatus according to claim 10, further comprising:

a fixing device configured to be heated to a decoloring temperature at which an image that is printed with a decolorable toner becomes decolored, wherein, if a sheet that is decolored by the fixing device is accommodated in the tray, the drive mechanism moves the sheet support to press the decolored sheet against the plate member.

18. The apparatus according to claim 10, wherein the drive mechanism includes a contacting flange that moves up and down in a cylinder formed in the sheet support, and moves the sheet support when the contacting flange moves up while contacting the sheet support at an upper wall of the cylinder.

* * * * *